US009334142B2

(12) United States Patent
Menchini

(10) Patent No.: US 9,334,142 B2
(45) Date of Patent: May 10, 2016

(54) METHOD AND DEVICE FOR INSTALLING AN ELEVATOR IN AN ELEVATOR SHAFT

(75) Inventor: Stefano Menchini, Camorino (CH)

(73) Assignee: Inventio AG, Hergiswil (CH)

( * ) Notice: Subject to any disclaimer, the term of this patent is extended or adjusted under 35 U.S.C. 154(b) by 465 days.

(21) Appl. No.: 13/643,848

(22) PCT Filed: Apr. 8, 2011

(86) PCT No.: PCT/EP2011/055561

§ 371 (c)(1),
(2), (4) Date: Oct. 26, 2012

(87) PCT Pub. No.: WO2011/134773

PCT Pub. Date: Nov. 3, 2011

(65) Prior Publication Data

US 2013/0036598 A1 Feb. 14, 2013

(30) Foreign Application Priority Data

Apr. 30, 2010 (EP) ..... 10161633

(51) Int. Cl.
*B66B 7/02* (2006.01)
*B66B 19/00* (2006.01)

(52) U.S. Cl.
CPC ..... *B66B 19/002* (2013.01); *Y10T 29/49895* (2015.01)

(58) Field of Classification Search
CPC ..... B66B 19/002; B66B 7/1246; Y10T 29/49895
See application file for complete search history.

(56) References Cited

U.S. PATENT DOCUMENTS

| | | | | |
|---|---|---|---|---|
| 3,851,736 | A | 12/1974 | Westlake et al. | |
| 8,397,437 | B2 * | 3/2013 | Barneman et al. | 52/30 |
| 8,400,644 | B2 * | 3/2013 | Juvonen et al. | 356/625 |
| 2010/0287876 | A1 * | 11/2010 | Van Der Meijden et al. | 52/741.1 |

FOREIGN PATENT DOCUMENTS

| | | | |
|---|---|---|---|
| WO | 2009/073010 | A1 | 6/2009 |
| WO | 2010/078416 | A1 | 7/2010 |
| WO | WO 2010116032 | A1 * | 10/2010 |

* cited by examiner

*Primary Examiner* — David Bryant
*Assistant Examiner* — Jun Yoo
(74) *Attorney, Agent, or Firm* — Fraser Clemens Martin & Miller LLC; William J. Clemens

(57) ABSTRACT

The invention relates to a method and device for installing an elevator in an elevator shaft, having the following steps: i) arranging a model in the elevator shaft, so that the arranged model represents nominal dimensions of an outline of the elevator; ii) arranging at least one light source at a nominal position of the model, so that the light source is directed in a provided travel direction of the elevator; iii) projecting a light beam starting from the light source, wherein the light beam defines the nominal position along the provided travel direction in the elevator shaft; and iv) using information about at least one location of at least one projection point of the light beam in the elevator shaft for installing the elevator.

11 Claims, 5 Drawing Sheets

METHOD AND DEVICE FOR INSTALLING AN ELEVATOR IN AN ELEVATOR SHAFT

FIELD

The subject of the invention is a method for installing an elevator in an elevator shaft, and a device for installing an elevator in an elevator shaft.

BACKGROUND

Elevators are frequently installed in elevator shafts of buildings. In order to make optimum use of the space of a building, an elevator shaft should be as small as possible, and an elevator should utilize the elevator shaft as completely as possible. Consequently, elevator shafts are narrowly dimensioned so that optimum utilization of a building can be realized.

It can occur that an elevator shaft is dimensioned such that an elevator intended for it can find no space therein, or finds space only when it is arranged very exactly at a specific location in the elevator shaft. Consequently, following installation of an elevator an elevator shaft is frequently measured so that a fitter can be certain that the elevator really can be installed. If it is established in the measurement that the elevator shaft is too small, the elevator shaft can, if appropriate, be adapted, for example by smoothing shaft walls.

This measurement of the elevator shaft is conventionally accomplished with the aid of vertical ribbons. In this case, suspension means are fitted on a shaft ceiling at measured points so that the vertical ribbons hang at prescribed positions in the shaft space. However, this method requires a long time, since the fitter must undertake measurements, drilling and installation both in the shaft head and on the shaft floor.

Published patent application WO 2009/073010 describes a method and a device for measuring elevator shafts. In this case, a platform is moved in a longitudinal direction of the elevator shaft and distance sensors measure distances between this platform and the shaft walls. The platform is moved by a drive, and a position of the platform can be checked by light sensors. On the one hand, this solution supplies more accurate data for the dimensions of the elevator shaft, and removes the need to fit vertical ribbons on the shaft ceiling. However, there is the disadvantage here that it is necessary to install a drive and guidance system for the platform. In addition, this solution is expensive and complicated to produce.

SUMMARY

One object of the present invention is therefore to provide a method for installing an elevator in an elevator shaft that can be carried out easily and quickly, and permits a sufficiently accurate checking of the shaft space dimensions. In addition, the method is to determine installation points in a simple fashion.

An inventive method for achieving this object relates to a method for installing an elevator in an elevator shaft which comprises the following steps: i) arranging a model in the elevator shaft so that the arranged model represents nominal dimensions of an outline of the elevator; ii) arranging at least one light source at a nominal position of the model so that the light source points in a prescribed travel direction of the elevator; iii) projecting a light beam starting from the light source, the light beam defining the nominal position along the prescribed travel direction in the elevator shaft; and iv) using an item of information of at least one position of at least one projection point of the light beam in the elevator shaft for the installation of the elevator.

In accordance with a preferred embodiment, the nominal dimensions correspond to a nominal depth and a nominal width of the elevator so that it can be checked whether the elevator shaft offers sufficient space for the envisaged elevator.

In accordance with a further preferred embodiment, the nominal position corresponds to an installation point. This permits installation points on the shaft floor and/or on the shaft ceiling to be determined in a simple fashion.

In accordance with a further preferred embodiment, the light beam is used to align guide rails and/or shaft doors and/or a drive in the elevator shaft.

A further object of the present invention consists in providing a device for installing an elevator in an elevator shaft that does not have the disadvantages cited above. The device is intended to permit the carrying out of the inventive method, and to be cost-effective in production as well as easy to use.

An inventive device for achieving said object relates to a device for installing an elevator in an elevator shaft, the device comprising a model with a frame and means for spatial alignment of the frame. The model is suitable for representing nominal dimensions of an outline of the elevator. A light source is provided for producing a light beam, model and light source being designed in such a way that the light source can be arranged on the frame in a prescribed way such that the light beam can be emitted in the direction of a prescribed travel direction of the elevator.

DESCRIPTION OF THE DRAWINGS

Details and further advantages of the invention are described below with the aid of exemplary embodiments and with reference to the diagrammatic drawings, in which.

DETAILED DESCRIPTION

Figure 1:
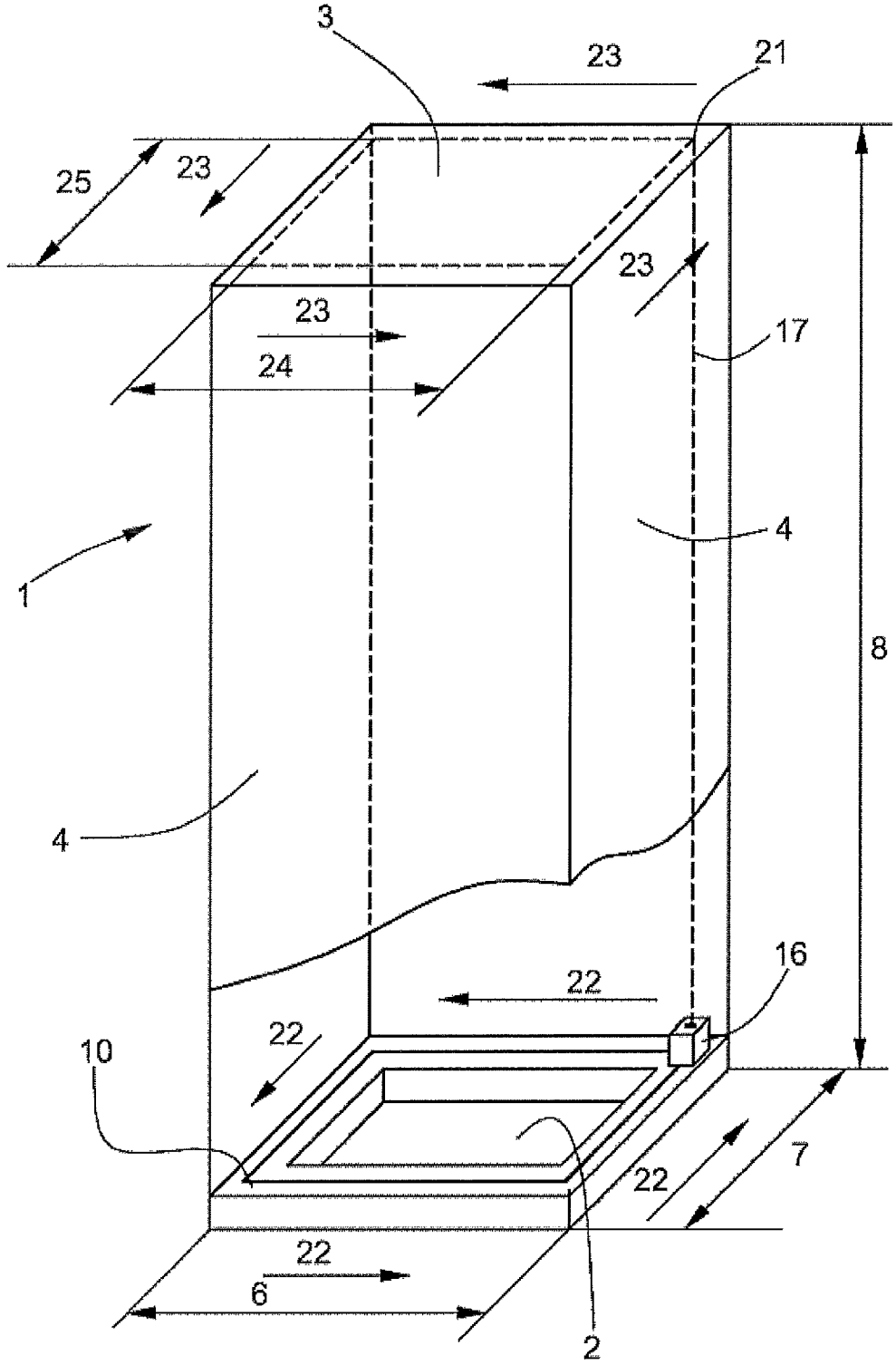
FIG. 1 shows an exemplary embodiment of an elevator shaft with a model arranged therein and with a light source, in a spatial illustration.

FIG. 1 shows an elevator shaft 1 with a model 10 arranged therein and with a light source 16 arranged thereon, in a spatial illustration. The elevator shaft 1 has a shaft floor 2, a shaft ceiling 3 and shaft walls 4. The elevator shaft 1 has a shaft height 8 and a shaft depth 6 and a shaft width 7. The elevator shaft 1 illustrated in FIG. 1 is cuboid. The shaft floor 2 and the shaft ceiling 3 have the same dimensions. In an alternative embodiment the shaft floor 2 and the shaft ceiling 3 do not have the same dimensions. It goes without saying to the person skilled in the art that elevator shafts 1 can be used with as many floors or shaft accesses as desired (not illustrated).

The model 10 is arranged on the shaft floor in the exemplary embodiment shown. In an alternative exemplary embodiment (not illustrated), the model 10 is arranged at any desired height above the shaft floor. The light source 16 sends a light beam 17 through the elevator shaft 1. When the model 10 is appropriately aligned spatially, a projection point 21 that corresponds to a position of the light source 16 on the model 10 is produced on the shaft ceiling 3 of the elevator shaft 1.

The light source 16 can be displaced on the model 10 along the arrows 22 that specify a displacement movement of the light source 16. The projection point 21 is displaced on the shaft ceiling 3 by such a displacement 22 of the light source 16 on the model 10, the projection point 21 executing the same displacement movement as the light source 16. The arrows 23 illustrate a displacement movement of the projection point 21 that corresponds to a displacement movement 22 of the light source 16.

Since the model 10 represents nominal dimensions of an outline of an elevator, it can be checked in this way whether these nominal dimensions of the elevator have sufficient space over the entire height of the elevator shaft 1. If the light source 16 is moved along the model 10, the projection point 21 should impinge on the shaft ceiling 3 at any time. If the light beam 17 is prevented by a shaft wall 4 from reaching the shaft ceiling 3, the nominal dimension of the elevator is not available over the entire height of the elevator shaft 1. If this is the case, an attempt can be made to reposition the model 10. If no arrangement of the model 10 in the elevator shaft 1 can be found, by which the light beam 17 continues to reach the shaft ceiling 3, the nominal dimension of the elevator is not available over the entire height of the elevator shaft 1.

In the exemplary embodiment illustrated in FIG. 1, a first side length of the rectangular model 10 corresponds to a nominal depth 24 of the elevator, and a second side length of the rectangular model 10 corresponds to a nominal width 25 of the elevator. In an alternative exemplary embodiment, the model 10 is not rectangular, but circular, such that an elevator shaft can be checked for the nominal dimensions of an elevator with a circular outline.

Figure 6:
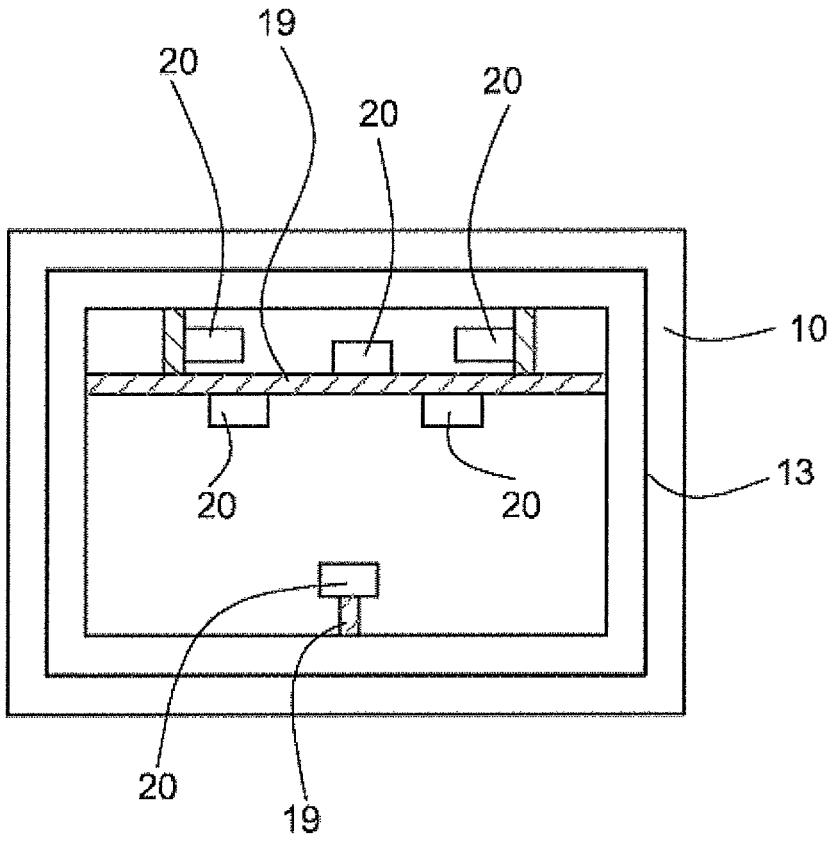
FIG. 6 shows an exemplary embodiment of a model with holding elements for holding a light source, in plan view.

In order to determine nominal positions, the model 10 can be designed with holding elements 20 for holding the light source 16, as illustrated in FIG. 6.

Figure 2:
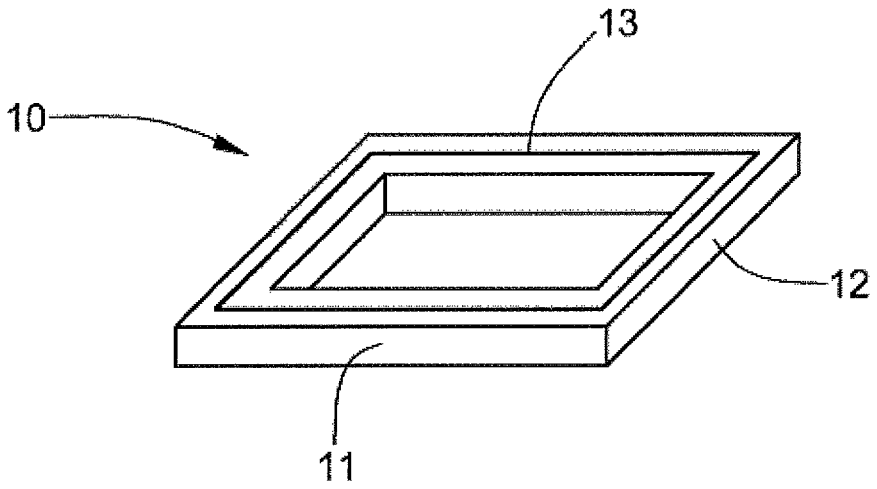
FIG. 2 shows an exemplary embodiment of a model in a spatial illustration.

FIG. 2 shows a model 10 in a spatial illustration. The model 10 has a frame with a model wide side 11 and a model deep side 12. The model 10 is rectangular in design. In this case, two oppositely arranged model wide sides 11 and two oppositely arranged model deep sides 12 respectively form the sides of a rectangle shaped frame. Both model wide sides 11 and model deep sides 12 have a rectangular cross section. A guide 13 is arranged on a top side of the model wide side 11 and model deep side 12. This guide 13 runs along the model wide sides 11 and the model deep sides 12 so that the guide 13 likewise has a rectangular shape.

Figure 3:
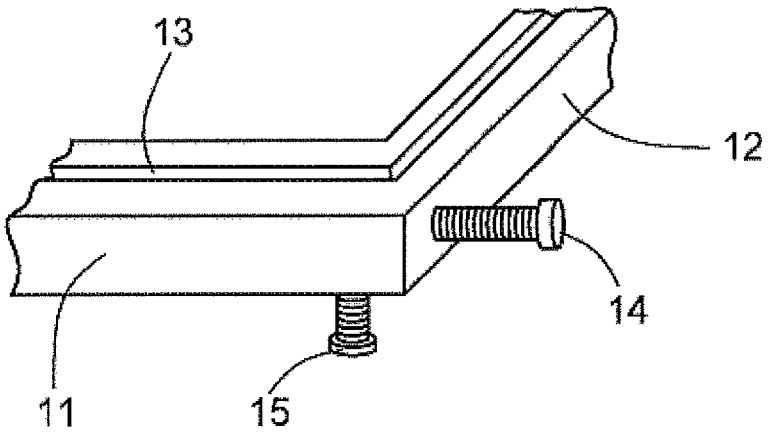
FIG. 3 shows an exemplary embodiment of an alignment device for spatial alignment of the model, in a spatial illustration.

FIG. 3 shows a part of the model 10 and means for spatial alignment of the model 10, in a spatial illustration. A model wide side 11 and a model deep side 12 form a corner of the model 10. In turn, the model 10 has the guide 13 on its top side. A support foot 15 is arranged on a bottom side of the model 10. This support foot 15 has a thread so that it is connected to the model 10 in height-adjustable fashion. A locking means 14 is arranged on a laterally aligned surface of the model 10. Like the support foot 15, the locking means 14 is also adjustably connected to the model 10. In the exemplary embodiment illustrated, the locking means 14 likewise has a thread.

A multiplicity of support feet 15 and locking means 14 can be arranged on the model 10. The support feet 15 permit a spatial alignment of the model 10 when it is arranged on the shaft floor. The locking means 14 permit a spatial alignment of the model 10 when it is arranged above the shaft floor. The model 10 can therefore be arranged and spatially aligned in the elevator shaft at any desired height above the shaft floor.

Figure 4:
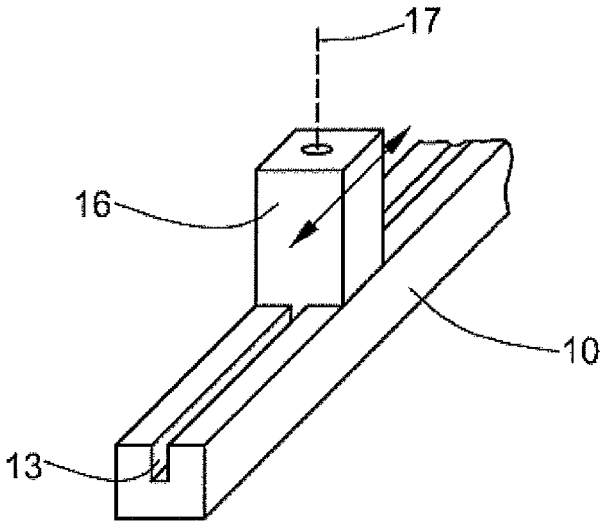
FIG. 4 shows an exemplary embodiment of a light source and a section of the model, in a spatial illustration.

FIG. 4 shows a light source 16 and a section of the model 10, in a spatial illustration. The light source 16 is arranged displaceably on the model 10. In the exemplary embodiment illustrated, the light source 16 can be displaced along the guide 13 of the model 10. As a result of this, a light beam 17 emitted by the light source 16 is displaced in parallel given a displacement of the light source 16.

Figure 5:
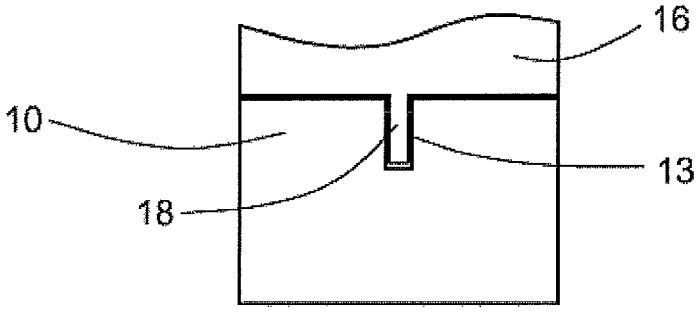
FIG. 5 shows an exemplary embodiment of a guide of the model and a guiding element of the light source, in a cross-sectional illustration.

FIG. 5 shows a guide 13 of the model 10, and a guiding element 18 of the light source 16, in a cross-sectional illustration. As illustrated in FIG. 4, the light source 16 can be displaced along the guide 13. In accordance with the exemplary embodiment illustrated in FIG. 5, the guiding element 18, which is connected to the light source 16, engages in the guide 13 of the model 10. The guiding element 18 and the guide 13 are dimensioned such that the light source 16 can substantially be displaced only in the prescribed direction, specifically along the guide 13. The guiding element 18 can, for example, be configured in the shape of a keel or bolt.

In an alternative exemplary embodiment, the model 10 has a guiding element, and the light source 16 has a guide. It is evident to the person skilled in the art that the guidance of the light source 16 along the model 10 can be fashioned in various ways. Thus, the light source 16 can, for example, also include guiding elements which grip around the model 10. What is important is that the light source 16 can be displaced along the model 10 on a prescribed line.

The light source 16 is preferably guided on the model 10 in such a way that a spatial alignment of the light source 16, and thus a direction of the light beam 17 emitted by the light source, always remain the same given a displacement of the light source 16 on the model 10. The light source 16 is therefore preferably displaced parallel to its beam direction on the model 10.

FIG. 6 shows a model 10 with holding elements 20 for holding a light source 16, in plan view. The guide 13, which is located on the top side of the model 10, is visible once again in this illustration. A support structure 19 is arranged on the model 10. Arranged, in turn, on this support structure 19 are holding elements 20 for holding the light source. As illustrated in FIG. 6, in order to hold the light source, these holding elements 20 can be designed as half-open containers with a rectangular cross section. In this exemplary embodiment, a light source can be introduced from above into the holding elements 20 in order to hold the light source.

The holding elements 20 for holding the light source are arranged on the support structure 19 in such a way that an inserted light source assumes a nominal position. By way of example, an installation point of a guide rail, or a spatial position of a guide rail can be selected as nominal position.

The holding elements 20 for holding the light source can be configured in such a way that a light source fits into the holding element 20 only in a predetermined orientation. This can, for example, be achieved by virtue of the fact that the light source has a trapezoidal cross section, and the holding element 20 has a corresponding trapezoidal cross section that is somewhat larger than the cross section of the light source. In an alternative embodiment, the holding elements 20 for holding the light source are not designed as containers, but as bolts onto which a light source with a corresponding recess can be plugged.

As shown in FIG. 6, a plurality of support structures 19 and a plurality of holding elements 20 fastened thereon for holding the light source 16 can be arranged on a model 10. The number and position of the holding elements 20 is governed by the number and position of the required installation points and alignment points.

Figure 7:
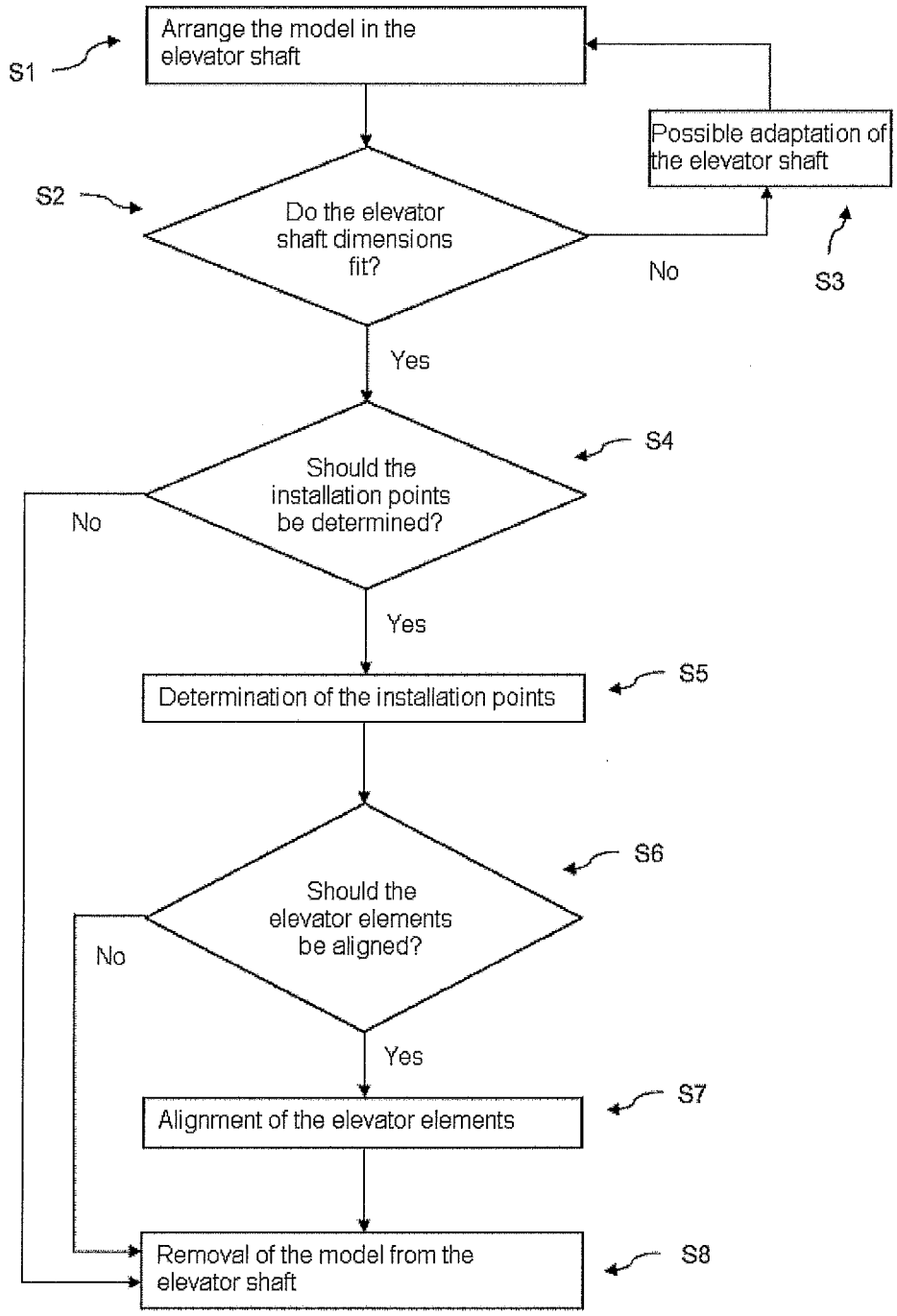
FIG. 7 shows a flowchart of an exemplary embodiment of a method for installing an elevator in an elevator shaft.

FIG. 7 shows a flowchart of a method for installing an elevator in an elevator shaft. In a first step S1, the model is arranged in the elevator shaft. In a second step S2, the shaft dimensions are checked. During this check of the shaft dimensions, it can, for example, be checked whether a nominal depth of the elevator and a nominal width of the elevator (as illustrated in FIG. 1) are available over the entire height of the elevator shaft. If the checking of the shaft dimensions turns out negative, the model must be rearranged in the elevator shaft. If appropriate, there is also a need for a further step S3 to adapt the shaft, for example by removing material from a shaft wall. If, by contrast, the checking of the shaft dimensions turns out to be positive, two options are available in step S4.

In the first option, in accordance with step S8 the model is removed from the shaft, and the method for installing the elevator in the elevator shaft is thereby terminated. In the second option, in accordance with step S5 installation points are now established. This can be executed, for example, with the aid of means for holding the light source, as illustrated in FIG. 6. In this case, the installation points can be inscribed both on the shaft ceiling and on the shaft floor. Once the determination of the installation points is finished, two options remain to be selected in accordance with step S6.

In the first option in accordance with step S8, the model is removed from the shaft, and the method for installing the elevator in the elevator shaft is concluded. In the second option in accordance with step S7, guide rails or other elevator components are now aligned. To this end, the light source is brought to the desired nominal position of the model. The guide rails, shaft doors or other elevator components can now be aligned in the shaft with the aid of the light beam. Once all the guide rails, shaft doors or other elevator components have been aligned, the model is removed from the shaft in accordance with step S8, and the method for installing the elevator in an elevator shaft is concluded.

The light source shown in the exemplary embodiments illustrated is preferably a laser. In this case, it is possible to arrange a plurality of lasers simultaneously on a model 10, or else to arrange only one laser that is displaced appropriately on the model 10. Alternatively, it is also possible to use lasers that can be aligned automatically with the aid of an installed water balance such that the light beam is directed vertically upward.

The model 10 can be configured as an aluminum profile. As illustrated in FIG. 2, the model 10 can be of unipartite design. In an alternative embodiment, the model 10 comprises a plurality of constituents. Preferably, the model sides comprise two parts that can be displaced into one another. This has the advantage that a nominal width or a nominal depth of the model 10 can be varied such that one and the same model 10 can be used for various elevator types. The model 10 can in this case be configured in such a way that the displaceable model side constituents latch in at prescribed positions.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for installing an elevator in an elevator shaft, the method comprising the steps of:

arranging a model in the elevator shaft, the arranged model representing nominal dimensions of an outline of the elevator;

arranging at least one light source at the model pointing in a prescribed travel direction of the elevator;

projecting a light beam from the light source, the light beam forming a nominal position along the prescribed travel direction in the elevator shaft wherein the nominal position corresponds to an installation point in the elevator shaft;

using at least one position of at least one projection point of the light beam in the elevator shaft as a guide for installation of the elevator wherein the light source is arranged on the model to produce the light beam on at least one of a shaft ceiling and a shaft floor as a projection point that is used as the installation point; and installing at least a portion of the elevator at the installation point while using the light beam as the guide.

2. The method according to claim 1 wherein the light source is a laser, and the light beam is a laser beam.

3. The method according to claim 1 including arranging at least a second light source on the model.

4. The method according to claim 1 wherein the model is an alignment device that fixes a position of the model in the elevator shaft.

5. The method according to claim 1 wherein the nominal dimensions correspond to a nominal depth and a nominal width of the elevator.

6. The method according to claim 5 wherein the light source is arranged on the model to direct the light beam along an outer boundary of the elevator in a direction of at least one of a floor and a ceiling of the elevator shaft.

7. The method according to claim 6 wherein the light source is arranged displaceably along a guide of the model, the light beam always being directed along the outer boundary of the elevator in the direction of the at least one of the shaft floor and the shaft ceiling by a displacement movement of the light source along the guide.

8. The method according to claim 1 including determining whether the light beam is prevented from reaching the at least one of the shaft ceiling and the shaft floor.

9. The method according to claim 1 wherein the installation point is used to install a guide rail.

10. The method according to claim 1 wherein the light beam is used to align at least one of guide rails, shaft doors and a drive in the elevator shaft.

11. A method for installing an elevator in an elevator shaft, the method comprising the steps of:

arranging a model in the elevator shaft, the arranged model including a frame representing nominal dimensions of an outline of the elevator;

arranging at least one light source at the frame pointing in a prescribed travel direction of the elevator;

projecting a light beam from the light source, the light beam forming a nominal position along the prescribed travel direction in the elevator shaft wherein the nominal position corresponds to an installation point in the elevator shaft;

using at least one position of at least one projection point of the light beam in the elevator shaft as a guide for installation of the elevator wherein the light source is arranged on the frame to produce the light beam on at least one of a shaft ceiling and a shaft floor as a projection point that is used as the installation point; and wherein the frame has a guide formed therein, including engaging the light source in the guide and displacing the light source along the guide.

* * * * *